United States Patent [19]

Mitao et al.

[11] Patent Number: 4,983,357

[45] Date of Patent: Jan. 8, 1991

[54] HEAT-RESISTANT TIAL ALLOY EXCELLENT IN ROOM-TEMPERATURE FRACTURE TOUGHNESS, HIGH-TEMPERATURE OXIDATION RESISTANCE AND HIGH-TEMPERATURE STRENGTH

[75] Inventors: Shinji Mitao; Seishi Tsuyama; Kuninori Minakawa, all of Tokyo, Japan

[73] Assignee: NKK Corporation, Tokyo, Japan

[21] Appl. No.: 389,360

[22] Filed: Aug. 3, 1989

[30] Foreign Application Priority Data

Aug. 16, 1988 [JP] Japan ..... 63-203455

[51] Int. Cl.[5] ..... C22C 14/00; C22C 30/00

[52] U.S. Cl. ..... 420/418; 420/580

[58] Field of Search ..... 420/418, 580

[56] References Cited

U.S. PATENT DOCUMENTS

| | | | |
|---|---|---|---|
| 2,880,087 | 3/1959 | Jaffee | 420/418 |
| 3,411,901 | 11/1968 | Winter | 420/418 |
| 4,294,615 | 10/1981 | Blackburn et al. | 420/420 |
| 4,836,983 | 6/1989 | Huang et al. | 420/421 |

FOREIGN PATENT DOCUMENTS

| | | | |
|---|---|---|---|
| 220571 | 7/1957 | Australia | 420/418 |
| 1533180 | 12/1969 | Fed. Rep. of Germany . | |
| 2462483 | 2/1981 | France . | |

OTHER PUBLICATIONS

Chem Abstracts 65:16627h 8/65 "Forgeable High--Temperature Resistant Alloys".

Joseph B. McAndrew et al. JOM 206; 10/56 pp. 1348–1353 "Ti-36 Pct Al as a Base for High Temperature Alloys".

S. M. L. Sastry et al. Met Trans A8A; 2/77 pp. 299–308 "Fatigue Deformation of TiAC Base Alloys" Akad Nauk Ukrain ssr, Metallofigikay 50, 1974, pp. 99–102.

Chem. Abstracts 65: 16628a 8/65, Forgeable High--Temperature Resistant Titanium Alloys.

Murray, "Phase Diagrams of Binary Titanium Alloys" (1987), pp. 12–24.

Nishiyama et al "Development of a Titanium Aluminide Turbocharger Rotor", International Gas Turbine Congress Paper, Tokyo, (1987), pp. III-263–270, 10/87.

*Primary Examiner*—R. Dean

*Assistant Examiner*—Margery S. Phipps

*Attorney, Agent, or Firm*—Frishauf, Holtz, Goodman & Woodward

[57] ABSTRACT

A heat-resistant TiAl alloy having excellent room-temperature fracture toughness, high-temperature oxidation resistance and high-temperature strength is disclosed. Said alloy consists essentially of from 29 to 35 wt. % aluminum, from 0.5 to 20 wt. % nobium, and at least one element selected from the group consisting of from 0.1 to 1.8 wt. % silicon, and from 0.3 to 5.5 wt. % zirconium, the balance being titanium and incidental impurities. Preferably impurities are limited to 0.6 wt.-% oxygen, 0.1 wt.-% nitrogen and 0.5 wt.-% hydrogen.

25 Claims, 7 Drawing Sheets

HEAT-RESISTANT TIAL ALLOY EXCELLENT IN ROOM-TEMPERATURE FRACTURE TOUGHNESS, HIGH-TEMPERATURE OXIDATION RESISTANCE AND HIGH-TEMPERATURE STRENGTH

REFERENCE TO PATENTS, APPLICATIONS AND PUBLICATIONS PERTINENT TO THE INVENTION

As far as we know, there is available the following prior art document pertinent to the present invention:

The U.S. Pat. No. 4,294,615 dated Oct. 13, 1981.

The contents of the prior art disclosed in the above-mentioned prior art document will be discussed hereafter under the heading of the "BACKGROUND OF THE INVENTION."

FIELD OF THE INVENTION

The present invention relates to a heat-resistant TiAl alloy excellent in a room-temperature fracture toughness, a high-temperature oxidation resistance and a high-temperature strength.

BACKGROUND OF THE INVENTION

A TiAl alloy, which is an intermetallic compound, has the following features: (1) It is light in weight. More specifically, the TiAl alloy has a specific gravity of about 3.7, equal to, or smaller than, a half that of the nickel superalloy. (2) It has an excellent high-temperature strength. More specifically, the TiAl alloy has a yield strength and a Young's modulus of the same order as that at room temperature in a temperature region near 800° C.

Research is now carried out for the purpose of practically applying the TiAl alloy light in weight and having an excellent high-temperature strength in place, for example, of the nickel superalloy or ceramics, which are used as materials for a turbine blade.

However, the conventional TiAl alloy has not as yet been practically applied as a material for high-temperature uses for the following reasons: (1) Room-temperature fracture toughness is not satisfactory. More specifically, at the "International Gas Turbine Congress" held in Tokyo in 1987, Mr. Y. Nishiyama et al. reported their finding that the TiAl alloy had a room-temperature fracture toughness (KIC) of 13 MPa$\sqrt{m}$. While this value of room-temperature fracture toughness is higher than that of $Si_3N_4$ and other structural ceramics of 5 MPa$\sqrt{m}$, there is a demand for a further higher value of the room-temperature fracture toughness. (2) High-temperature oxidation resistance is not satisfactory. More specifically, high-temperature oxidation resistance of the TiAl alloy, while being superior to that of the ordinary titanium alloy, is not always higher than that of the nickel superalloy. It is known that, particularly in the temperature region of at least 900° C., the high-temperature oxidation resistance of the TiAl alloy seriously decreases, and that the high-temperature oxidation resistance of the TiAl alloy is considerably improved by adding niobium. However, the addition of niobium does not improve the high-temperature strength of the TiAl alloy. (3) High-temperature strength is not very high. More specifically, while the TiAl alloy shows, as described above, a yield strength of the same order as that in the room temperature in the temperature region near 800° C., this value is not very high. Its about 390 MPa at the highest. Comparison of the TiAl alloy with the nickel superalloy such as the Inconel 713 alloy in terms of the specific strength as represented by the value obtained by dividing, by specific gravity, such a strength characteristic as tensile strength, compressive strength or creep rupture strength within the temperature range of from 700° to 1,100° C., shows almost no difference between these alloys and it is improbable that the conventional TiAl alloy will substitute for the nickel superalloy, when taking account of the fact that the nickel superalloy is superior in ductility and toughness at room temperature.

It would however be possible to use the TiAl alloy in place of the nickel superalloy as a material for a member requiring reasonably high ductility and toughness by improving the high-temperature strength of the TiAl alloy to increase the specific strength thereof. Considering the fact that the TiAl alloy is superior to the ceramics in ductility and toughness, it would be possible to use the TiAl alloy in place of the structural ceramics used within the temperature range of from 700° to 1,000° C.

With regard to the effect of the alloy elements on the high-temperature strength of the TiAl alloy, the following finding is disclosed in the U.S. Pat. No. 4,294,615 dated Oct. 13, 1981: A Ti-31 to 36 wt. % Al-0.1 to 4 wt. % V TiAl alloy is excellent in high-temperature strength and room-temperature ductility, and the addition of 0.1 wt. % carbon to the above-mentioned TiAl alloy improves a creep rupture strength thereof (hereinafter referred to as the "prior art").

However, the specific strength of the TiAl alloy of the prior art as described above is insufficient, being almost equal to that of the nickel superalloy.

Under such circumstances, there is a strong demand for the development of a heat-resistant TiAl alloy excellent in room-temperature fracture toughness, high-temperature oxidation resistance and high-temperature strength, one which exhibits a room-temperature fracture toughness of at least 13 MPa$\sqrt{m}$, a 100-hour creep rupture strength at a temperature of 820° C. higher than that of the conventional TiAl alloy, and a decrease in thickness of up to 0.1 mm per side after heating to a temperature of 900° C. in the open air for 500 hours, but a TiAl alloy having such characteristics has not as yet been proposed.

SUMMARY OF THE INVENTION

An object of the present invention is therefore to provide a heat-resistant TiAl alloy excellent in room-temperature fracture toughness, high-temperature oxidation resistance and high-temperature strength, one which exhibits a room-temperature fracture toughness of at least 13 MPa$\sqrt{m}$, a 100-hour creep rupture strength at a temperature of 820° C. higher than that of the conventional TiAl alloy, and a decrease in thickness of up to 0.1 mm per side after heating to a temperature of 900° C. in the open air for 500 hours.

In accordance with one of the features of the present invention, a heat-resistant TiAl alloy excellent in a room-temperature fracture toughness, a high-temperature oxidation resistance and a high-temperature strength is provided, characterized by consisting essentially of:

| | |
|---|---|
| aluminum | from 29 to 35 wt. %, |
| niobium | from 0.5 to 20 wt. %, |

at least one element selected from the group consisting of:

| | |
|---|---|
| silicon | from 0.1 to 1.8 wt. %, |
| and | |
| zirconium | from 0.3 to 5.5 wt. %, |

and the balance being titanium and incidental impurities.

DETAILED DESCRIPTION OF PREFERRED EMBODIMENTS

Figure 1:
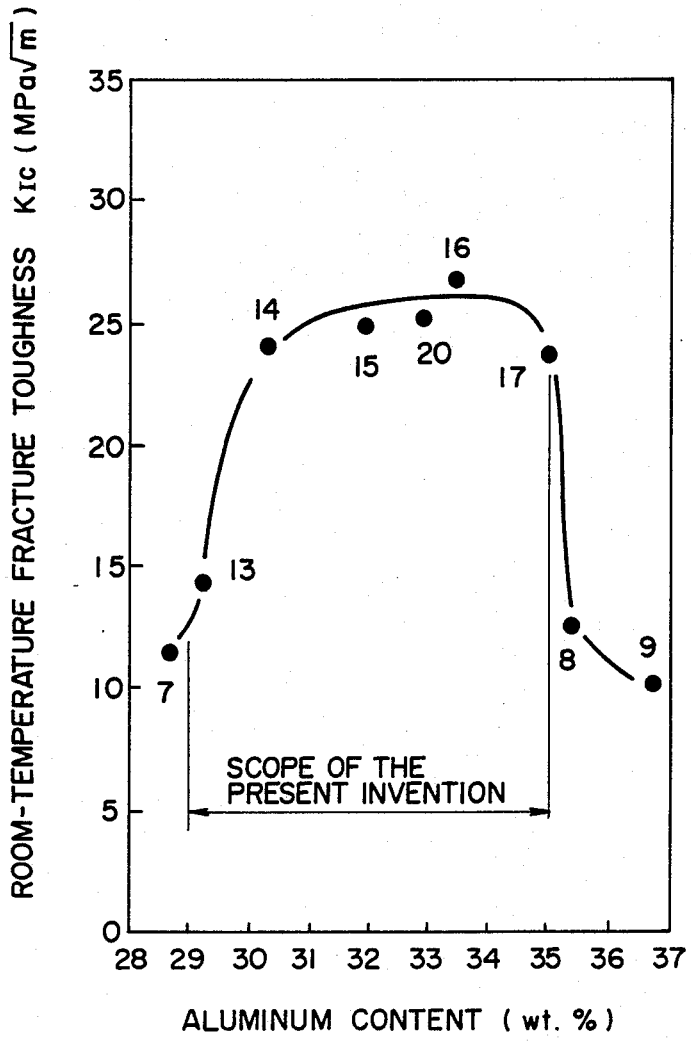
FIG. 1 is a graph illustrating the relationship between the aluminum content and the room-temperature fracture toughness in a TiAl alloy.

From the above-mentioned point of view, extensive studies were carried out with a view to developing a heat-resistant TiAl alloy excellent in room-temperature fracture toughness, high-temperature oxidation resistance and high-temperature strength. As a result, the following finding was obtained: it is possible to obtain a heat-resistant TiAl alloy that has excellent room-temperature fracture toughness, high-temperature oxidation resistance and high-temperature strength, by adding a prescribed amount of niobium and at least one of silicon and/or zirconium.

The present invention was developed on the basis of the above-mentioned finding, and the heat-resistant TiAl alloy of the present invention excellent in room-temperature fracture toughness, high-temperature oxidation resistance and high-temperature strength consists essentially of:

| | |
|---|---|
| aluminum | from 29 to 35 wt. %, |
| niobium | from 0.5 to 20 wt. %, |

at least one element selected from the group consisting of:

| | |
|---|---|
| silicon | from 0.1 to 1.8 wt. %, |
| and | |
| zirconium | from 0.3 to 5.5 wt. %, |

and the balance being titanium and incidental impurities.

The chemical composition of the heat-resistant TiAl alloy of the present invention excellent in room-temperature fracture toughness, high-temperature oxidation resistance and high-temperature strength is limited within the range as described above for the following reasons:

(1) Aluminum

Aluminum has the function of improving room-temperature fracture toughness and high-temperature strength of the TiAl alloy. With an aluminum content of under 29 wt. %, however, the desired effect as described above cannot be obtained. With an aluminum content of over 35 wt. %, on the other hand, a particular improvement in the above-mentioned effect described above is not available. In order to use a TiAl alloy poor in a room-temperature fracture toughness and a high-temperature strength as a structural material, it is necessary to consume much labor for ensuring high reliability. In addition, advantages over a structural ceramics such as $Si_3N_4$ are too slight to achieve the object of the present invention. The aluminum content should therefore be limited within the range of from 29 to 35 wt. %.

(2) Niobium

Niobium, which is not very responsible for improving the strength of the TiAl alloy, has the function of largely improving the high-temperature oxidation resistance of the TiAl alloy. With a niobium content of under 0.5 wt. %, however, a desired effect as described above cannot be obtained. With a niobium content of over 20 wt. %, on the other hand, with specific gravity of the TiAl alloy becomes larger, thus preventing achievement of a smaller weight, and the creep rupture strength of the TiAl alloy decreases. The niobium content should therefore be limited within the range of from 0.5 to 20 wt. %.

(3) Silicon

Silicon has the function of improving the high-temperature strength of the TiAl alloy. With a silicon content of under 0.1 wt. %, however, a desired effect as described above cannot be obtained. A silicon content of over 1.8 wt. %, on the other hand, largely reduces the room-temperature fracture toughness of the TiAl alloy. The silicon content should therefore be limited within the range of from 0.1 to 1.8 wt. %.

(4) Zirconium

Zirconium has, like silicon, the function of improving the high-temperature strength of the TiAl alloy. With a zirconium content of under 0.3 wt. %, however, a desired effect as described above, cannot be obtained. With a zirconium content of over 5.5 wt. %, on the other hand, a room-temperature fracture toughness of the TiAl alloy decreases considerably, and the specific gravity of the TiAl alloy increases thus preventing achievement of a smaller weight. The zirconium content should therefore be limited within the range of from 0.3 to 5.5 wt. %.

In the present invention, the respective contents of oxygen, nitrogen and hydrogen as incidental impurities in the TiAl alloy should preferably be limited as follows with a view to preventing a room-temperature fracture toughness of the TiAl alloy from decreasing:

up to 0.6 wt. % for oxygen, up to 0.1 wt. % for nitrogen, and up to 0.05 wt. % for hydrogen.

Now, the heat-resistant TiAl alloy of the present invention excellent in room-temperature fracture toughness, high-temperature oxidation resistance and high-temperature strength, is described further in detail by means of an example.

EXAMPLE

TiAl alloys each having a chemical composition within the scope of the present invention as shown in Table 1 and TiAl alloys each having a chemical composition outside the scope of the present invention as shown also in Table 1, were melted in a melting furnace, and then cast into ingots. Then, fracture toughness test pieces of the TiAl alloys within the scope of the present invention based on "ASTM E399" (hereinafter referred to as the "test pieces of the invention") Nos. 13 to 32, and fracture toughness test pieces of the TiAl alloys outside the scope of the present invention also based on "ASTM E399" (hereinafter referred to as the "test pieces for comparison") Nos. 1 to 12, were cut from the respective ingots thus cast.

Room-temperature fracture toughness was then measured in accordance with "ASTM E 399" for each of these test pieces. From among the results of measurement, those for the test pieces of the invention Nos. 13 to 31 and those for the test pieces for comparison Nos. 4, 5 and 7 to 12 are shown in Table 2.

Figure 2:
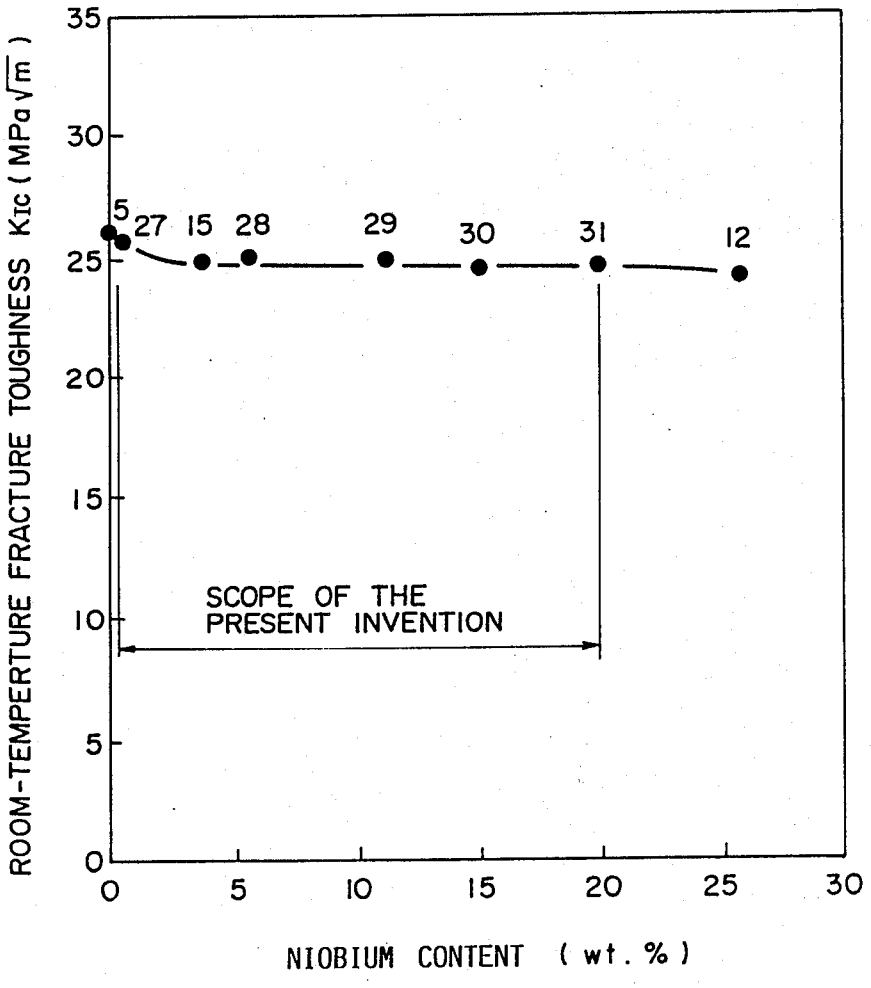
FIG. 2 is a graph illustrating the relationship between the niobium content and the room-temperature fracture toughness in a TiAl alloy.
Figure 3:
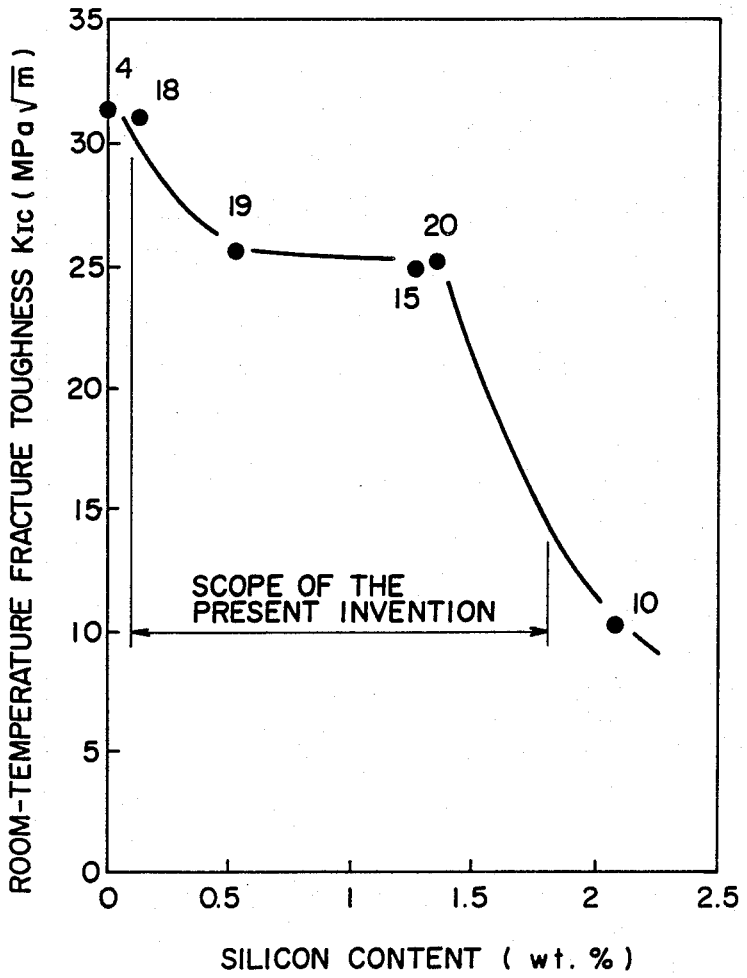
FIG. 3 is a graph illustrating the relationship between the silicon content and the room-temperature fracture toughness in a TiAl alloy.
Figure 4:
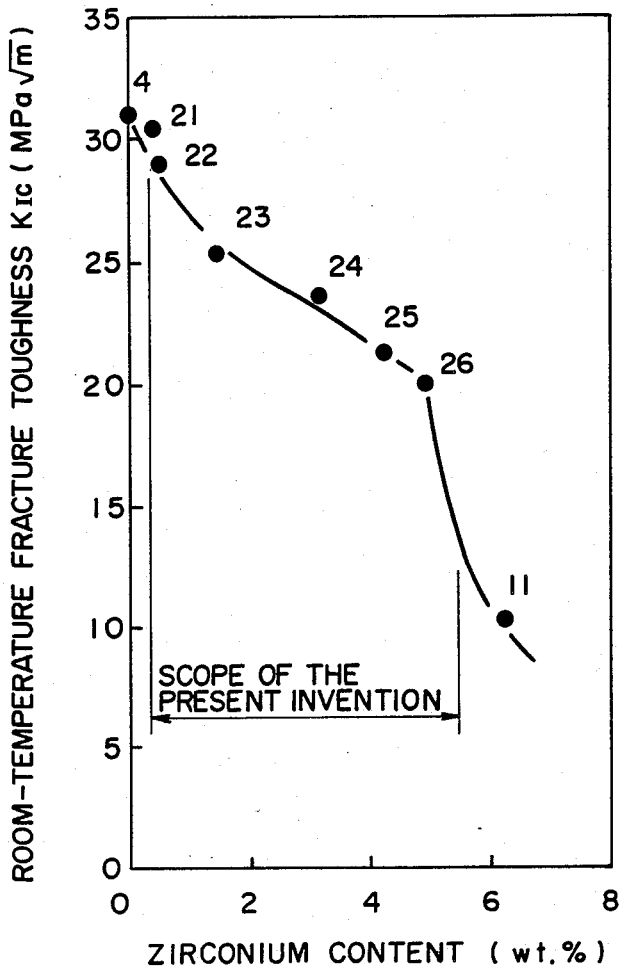
FIG. 4 is a graph illustrating the relationship between the zirconium content and the room-temperature fracture toughness in a TiAl alloy.

For the purpose of demonstrating the effect of the respective contents of aluminum, niobium, silicon and zirconium on the room-temperature fracture toughness of the TiAl alloy, the relationship between the aluminum content and the room-temperature fracture toughness is shown in FIG. 1 for the test pieces of the invention Nos. 13 to 17 and 20 and the test pieces for comparison Nos. 7 to 9, which are the Ti-Al-4 wt. % Nb-1 wt. % Si TiAl alloys; the relationship between the niobium content and the room-temperature fracture toughness is shown in FIG. 2 for the test pieces of the invention Nos. 15 and 27 to 31 and the test pieces for comparison Nos. 5 and 12, which are the Ti-33 wt. % Al-Nb-1 wt. % Si TiAl alloys; the relationship between the silicon content and the room-temperature fracture toughness is shown in FIG. 3 for the test pieces of the invention Nos. 18 to 20 and the test pieces for comparison Nos. 4 and 10, which are the Ti-33 wt. % Al-4 wt. % Nb-Si TiAl alloys; and the relationship between the zirconium content and the room-temperature fracture toughness is shown in FIG. 4 for the test pieces of the invention Nos. 21 to 26 and the test pieces for comparison Nos. 4 to 11, which are the Ti-33 wt. % Al-2 wt. % Nb-Zr TiAl alloys.

TABLE 1

| | No. | Chemical composition (wt. %) Al | Nb | Si | Zr | Others | | No. | Chemical composition (wt. %) Al | Nb | Si | Zr | Others |
|---|---|---|---|---|---|---|---|---|---|---|---|---|---|
| Test pieces for comparison | 1 | 35.25 | — | — | — | — | Test pieces of the invention | 13 | 29.26 | 4.31 | 0.92 | — | — |
| | 2 | 34.21 | — | — | — | V: 1.48 C: 0.24 | | 14 | 30.30 | 4.12 | 0.97 | — | — |
| | 3 | 35.74 | — | 0.03 | — | Ni: 0.27 B:0.04 | | 15 | 31.94 | 3.86 | 1.28 | — | — |
| | 4 | 32.38 | 5.18 | — | — | — | | 16 | 33.45 | 4.04 | 1.03 | — | — |
| | | | | | | | | 17 | 34.93 | 4.08 | 0.98 | — | — |
| | | | | | | | | 18 | 32.95 | 5.03 | 0.11 | — | — |
| | 5 | 32.91 | — | 0.51 | — | — | | 19 | 32.47 | 4.92 | 0.52 | — | — |
| | 6 | 33.64 | — | — | 3.04 | — | | 20 | 32.90 | 4.84 | 1.36 | — | — |
| | 7 | 28.67 | 4.08 | 0.89 | — | — | | 21 | 33.07 | 2.53 | — | 0.32 | — |
| | 8 | 35.39 | 4.19 | 0.85 | — | — | | 22 | 32.63 | 2.77 | — | 0.50 | — |
| | 9 | 36.74 | 3.93 | 0.85 | — | — | | 23 | 33.47 | 2.46 | — | 1.43 | — |
| | 10 | 33.25 | 4.16 | 2.09 | — | — | | 24 | 31.95 | 2.03 | — | 3.19 | — |
| | 11 | 32.04 | 2.31 | — | 6.24 | — | | 25 | 32.44 | 2.38 | — | 4.25 | — |
| | 12 | 31.91 | 25.72 | 0.85 | — | — | | 26 | 33.08 | 2.09 | — | 4.95 | — |
| | | | | | | | | 27 | 32.41 | 0.52 | 1.39 | — | — |
| | | | | | | | | 28 | 33.06 | 5.61 | 1.04 | — | — |
| | | | | | | | | 29 | 32.47 | 11.08 | 0.92 | — | — |
| | | | | | | | | 30 | 32.92 | 14.97 | 1.11 | — | — |
| | | | | | | | | 31 | 33.09 | 19.89 | 0.97 | — | — |
| | | | | | | | | 32 | 32.68 | 1.86 | 1.00 | — | — |

TABLE 2

| No. | Room-temp. fracture toughness KIC(MPa $\sqrt{m}$) |
|---|---|
| Test pieces for comparison | |
| 4 | 31.2 |
| 5 | 26.1 |
| 7 | 11.5 |
| 8 | 12.9 |
| 9 | 10.9 |
| 10 | 10.1 |
| 11 | 10.1 |
| 12 | 24.0 |
| Test pieces of the invention | |
| 13 | 14.3 |
| 14 | 24.0 |
| 15 | 24.9 |
| 16 | 26.7 |
| 17 | 23.8 |
| 18 | 31.0 |
| 19 | 25.6 |
| 20 | 25.2 |
| 21 | 30.3 |
| 22 | 29.5 |
| 23 | 25.1 |
| 24 | 23.4 |
| 25 | 21.2 |
| 26 | 20.0 |
| 27 | 25.8 |
| 28 | 25.0 |
| 29 | 24.9 |
| 30 | 24.6 |
| 31 | 24.6 |

As is clear from FIG. 1, the room-temperature fracture toughness of the TiAl alloy largely depends upon the aluminum content. More specifically, within the range of aluminum content of from 29 to 35 wt. %, the room-temperature fracture toughness (KIC) of the TiAl alloy becomes at least 13 MPa$\sqrt{m}$ which is the target value of the present invention. Then, as is clear from FIG. 2, the room-temperature fracture toughness of the TiAl alloy is hardly affected by the niobium content. Then, as is clear from FIG. 3, the room-temperature fracture toughness of the TiAl alloy becomes lower along with the increase in the silicon content. In order to obtain a room-temperature fracture toughness of at least 13 MPa$\sqrt{m}$, therefore, it is necessary to limit the silicon content to up to 1.8 wt. %. Then, as is clear from FIG. 4, the room-temperature fracture toughness of the TiAl alloy becomes lower along with the increase in the zirconium content. In order to obtain a room-temperature fracture tough 13 MPa$\sqrt{m}$, therefore, it is necessary to limit the zirconium content to up to 5.5 wt. %.

Then, TiAl alloys each having a chemical composition within the scope of the present invention as shown in Table 1 and TiAl alloys each having a chemical composition outside the scope of the present invention as shown also in Table 1, were melted in a melting furnace, and then cast into ingots. Then, test pieces of the TiAl alloys within the scope of the present invention (hereinafter referred to as the "test pieces of the invention") Nos. 13 to 32, each having a parallel portion with a diameter of 6 mm and a length of 30 mm, and test pieces of the TiAl alloys outside the scope of the present invention (hereinafter referred to as the "test pieces for comparison") Nos. 1 to 12, also each having a parallel portion with a diameter of 6 mm and a length of 30 mm, were cut from the respective ingots thus cast. A creep rupture strength at 820° C. was then measured for each of these test pieces. The relationship between the stress applied to the test piece and the creep rupture time is shown in FIG. 5.

Figure 5:
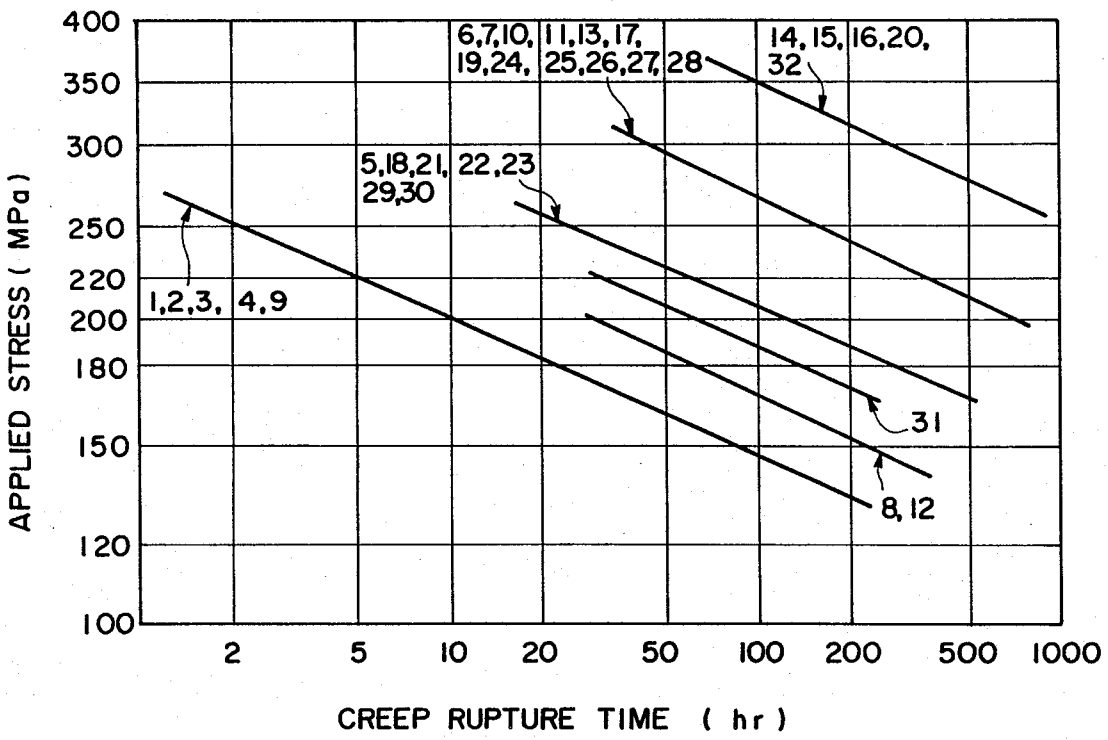
FIG. 5 is a graph illustrating the relationship between the applied stress and the creep rupture time in a TiAl alloy.

As is clear from FIG. 5, the test pieces are classified into several groups. More specifically, the test pieces for comparison Nos. 1 to 4 and 9 come under the lowest group in FIG. 5, having an applied stress at which the test piece ruptures after the lapse of 100 hours, i.e., a 100-hour creep rupture strength, of about 150 MPa. In contrast, the test pieces of the invention Nos. 14 to 16, 20 and 32 have a 100-hour creep rupture strength of about 350 MPa, a very high value.

Table 3 shows the niobium content, the 100-hour creep rupture strength at a temperature of 820° C. the specific gravity and the specific strength which is the value obtained by dividing the 100-hour creep rupture strength by the specific gravity, for each of the test pieces of the invention Nos. 15 and 27 to 31 and the test pieces for comparison Nos. 2, 5 and 12, which are the Ti-33 wt. % Al-Nb-1 wt. % Si TiAl alloy.

TABLE 3

| No. | | Nb content (wt. %) | 100-hour creep rupture strength (MPa) | Specific gravity (g/cm$^3$) | Specific strength ($\times 10^4$ cm) |
|---|---|---|---|---|---|
| Test piece for comparison | 2 | — | 150 | 3.80 | 39.5 |
| | 5 | — | 206 | 3.89 | 53.0 |
| | 12 | 25.72 | 167 | 4.32 | 38.7 |
| Test piece of the invention | 15 | 3.86 | 350 | 3.95 | 88.6 |
| | 27 | 0.52 | 265 | 3.90 | 67.9 |
| | 28 | 5.61 | 265 | 3.98 | 66.6 |
| | 29 | 11.08 | 206 | 4.07 | 50.6 |
| | 30 | 14.97 | 206 | 4.15 | 49.6 |
| | 31 | 19.89 | 186 | 4.23 | 44.0 |

As is clear from Table 3, the addition of niobium causes almost no change in a 100-hour creep rupture strength, which rather shows a tendency toward decreasing, while the specific gravity is increasing. Also as is evident from Table 3, in order to achieve a specific strength of over that for the test piece for comparison No. 2, which is the alloy of the prior art, of $39.5\times10^4$ cm, it is necessary to limit the niobium content of the TiAl alloy to up to 20 wt. %.

Table 4 shows an aluminum content and a 100-hour creep rupture strength at a temperature of 820° C. for each of the test pieces of the invention Nos. 13 to 17 and 20 and the test pieces for comparison Nos. 7 to 9, which are the Ti-Al-4 wt. % Nb-1 wt. % Si TiAl alloy; Table 5 shows a silicon content and a 100-hour creep rupture strength at a temperature of 820° C. for each of the test pieces of the invention Nos. 15 and 18 to 20 and the test pieces for comparison Nos. 4 and 10, which are the Ti-33 wt. % Al-4 wt. % Nb-Si TiAl alloy; and Table 6 shows a zirconium content and a 100-hour creep rupture strength at a temperature of 820° C. for each of the test pieces of the invention Nos. 21 to 26 and the test pieces for comparison Nos. 4 and 11, which are the Ti-33 wt. % Al-2 wt. % Nb-Zr TiAl alloy.

TABLE 4

| No. | | Al content (wt. %) | 100-hour creep rupture strength (MPa) |
|---|---|---|---|
| Test piece for comparison | 7 | 28.67 | 206 |
| | 8 | 35.39 | 167 |
| | 9 | 36.74 | 147 |
| Test piece of the invention | 13 | 29.26 | 265 |
| | 14 | 30.30 | 350 |
| | 15 | 31.94 | 350 |
| | 16 | 33.45 | 350 |
| | 17 | 34.93 | 265 |
| | 20 | 32.90 | 350 |

TABLE 5

| No. | | Si content (wt. %) | 100-hour creep rupture strength (MPa) |
|---|---|---|---|
| Test piece for comparison | 4 | — | 147 |
| | 10 | 2.09 | 270 |
| Test piece of the invention | 15 | 1.28 | 350 |
| | 18 | 0.11 | 206 |
| | 19 | 0.52 | 265 |
| | 20 | 1.36 | 350 |

TABLE 6

| No. | | Zr content (wt. %) | 100-hour creep rupture strength (MPa) |
|---|---|---|---|
| Test piece for comparison | 4 | — | 147 |
| | 11 | 6.24 | 270 |
| Test piece of the invention | 21 | 0.32 | 206 |
| | 22 | 0.50 | 206 |
| | 23 | 1.43 | 206 |
| | 24 | 3.19 | 265 |
| | 25 | 4.25 | 265 |
| | 26 | 4.95 | 265 |

As is clear from Tables 4, 5 and 6, it is possible to improve the high-temperature strength of the TiAl alloy by limiting the aluminum content within the range of from 29 to 35 wt. %, limiting the lower limit of the silicon content of 0.1 wt. %, and limiting the lower limit of the zirconium content of 0.3 wt. %.

Then, TiAl alloys each having a chemical composition within the scope of the present invention as shown in Table 1, and TiAl alloys each having a chemical composition outside the scope of the present invention as shown also in Table 1, were melted in a melting furnace, and then cast into ingots. Then, test pieces of the TiAl alloys within the scope of the present invention (hereinafter referred to as the "test pieces of the invention") Nos. 13 to 32, each having a longitudinal width of 8 mm, a transverse width of 10 mm and a thickness of 2 mm, and test pieces of the TiAl alloys outside the scope of the present invention (hereinafter referred to as the "test pieces for comparison") Nos. 1 to 12, also each having a longitudinal width of 8 mm, a transverse width of 10 mm and a thickness of 2 mm, were cut from the respective ingots thus cast. To investigate the high-temperature oxidation resistance, these test pieces were heated to a temperature of 900° C. in the open air for 100 hours, 200 hours and 500 hours, and a decrease in thickness per side of the test piece caused by oxidation after the lapse of these hours was measured. From among the results of measurement, those for the test pieces of the invention Nos. 15, 24 and 32 and the test pieces for comparison Nos. 1, 2 and 4 to 6 are shown in Table 7.

TABLE 7

| | | No. | Time lapse (hr.) 100 | 200 | 500 |
|---|---|---|---|---|---|
| Decrease in thickness (mm) | Test piece for comparison | 1 | 0.060 | 0.107 | 0.252 |
| | | 2 | 0.087 | 0.163 | 0.296 |
| | | 4 | 0.006 | 0.010 | 0.018 |
| | | 5 | 0.054 | 0.095 | 0.181 |
| | | 6 | 0.094 | 0.170 | 0.293 |
| | Test piece of the invention | 15 | 0.005 | 0.012 | 0.023 |
| | | 24 | 0.008 | 0.017 | 0.039 |
| | | 32 | 0.006 | 0.014 | 0.026 |

As is clear from Table 7, the addition of niobium brings about a remarkable improvement of a high-temperature oxidation resistance of the TiAl alloy, whereas the addition of silicon and zirconium does not exert a remarkable effect on the high-temperature oxidation resistance of the TiAl alloy.

Table 8 shows the niobium content and the high-temperature oxidation resistance for each of the test pieces of the invention Nos. 15 and 27 to 31 and the test pieces for comparison Nos. 5 and 12.

TABLE 8

| | | No. | Nb content (wt. %) | Time lapse (hr) 100 | 200 | 500 |
|---|---|---|---|---|---|---|
| Decrease in thickness (mm) | Time piece for comparison | 5 | — | 0.054 | 0.095 | 0.181 |
| | | 12 | 25.72 | 0.004 | 0.009 | 0.019 |
| | Time piece of the invention | 15 | 3.86 | 0.005 | 0.012 | 0.023 |
| | | 27 | 0.52 | 0.020 | 0.037 | 0.070 |
| | | 28 | 5.61 | 0,004 | 0.013 | 0.022 |
| | | 29 | 11.08 | 0.004 | 0.010 | 0.019 |
| | | 30 | 14.97 | 0.004 | 0.010 | 0.020 |
| | | 31 | 19.89 | 0.004 | 0.010 | 0.018 |

As is clear from Table 8, the addition of niobium in an amount of at least 0.5 wt. % results in an improvement of the high-temperature oxidation resistance of the TiAl alloy.

Figure 6:
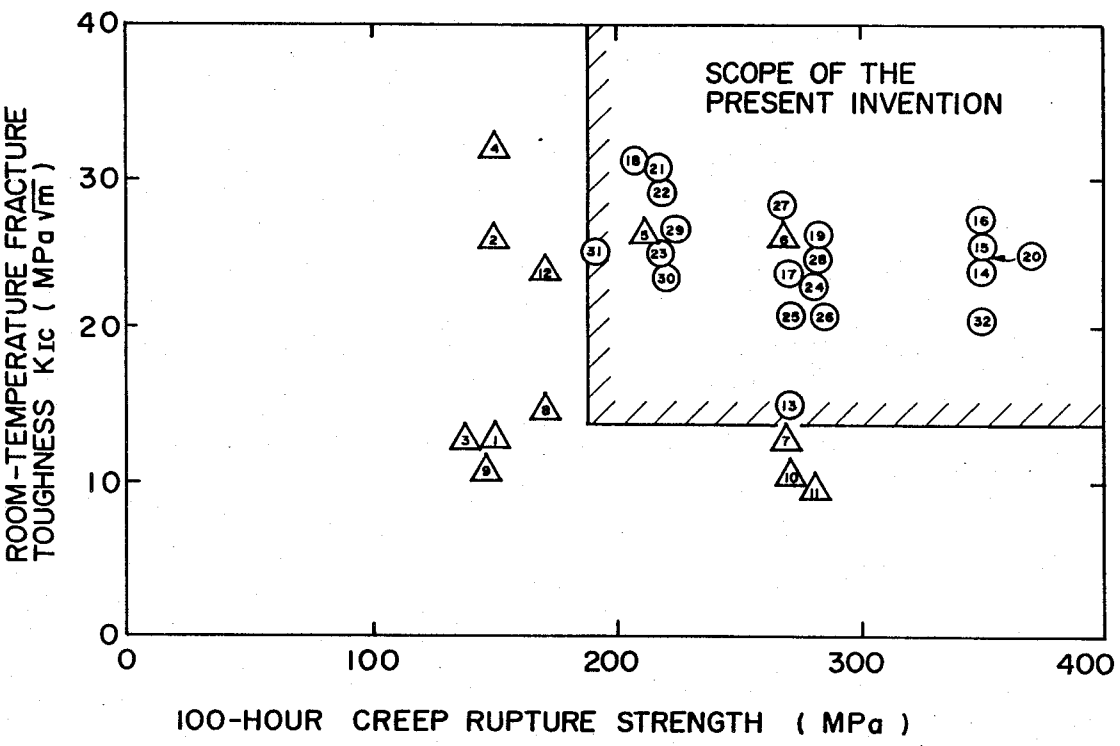
FIG. 6 is a graph illustrating the relationship between the room-temperature fracture toughness and the 100-hour creep rupture strength in a TiAl alloy.
Figure 7:
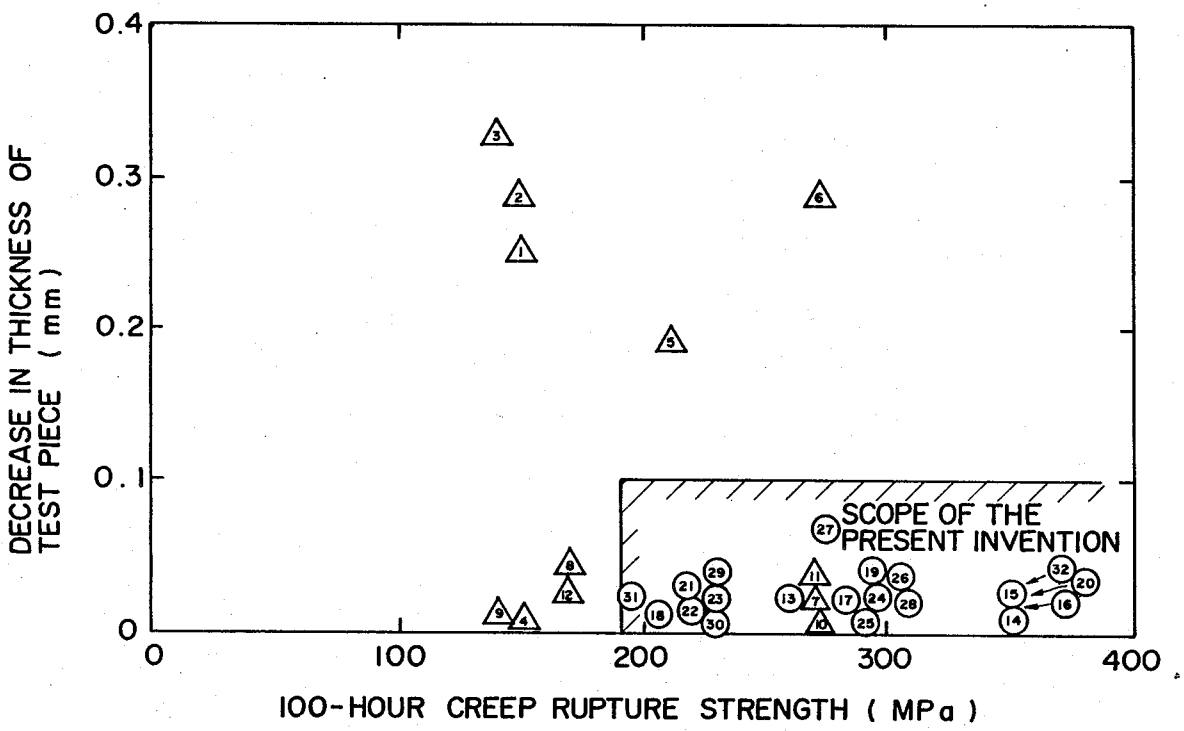
FIG. 7 is a graph illustrating the relationship between the decrease in thickness and the 100-hour creep rupture strength in a TiAl alloy.

The results of these measurements are illustrated in FIGS. 6 and 7. FIG. 6 is a graph illustrating the relationship between the room-temperature fracture toughness and the high-temperature strength, i.e., a 100-hour creep rupture strength at a temperature of 820° C. for each of the test pieces of the invention Nos. 13 to 32 and the test pieces for comparison Nos. 1 to 12. In FIG. 6, the region enclosed by hatching represents that of the present invention giving excellent room-temperature fracture toughness and high-temperature strength.

FIG. 7 is a graph illustrating the relationship between the high-temperature oxidation resistance, i.e., a decrease in thickness per side of the test piece after heating to a temperature of 900° C. in the open air for 500 hours, on the one hand, and the high-temperature strength, i.e., the 100-hour creep rupture strength at a temperature of 820° C., on the other hand, for each of the test pieces of the invention Nos. 13 to 32 and the test pieces for comparison Nos. 1 to 12. In FIG. 7, the region enclosed by hatching represents that of the present invention giving excellent high-temperature oxidation resistance and high-temperature strength.

As is clear from FIGS. 6 and 7, the test pieces of the invention Nos. 13 to 32 are excellent in room-temperature fracture toughness, high-temperature oxidation resistance and high-temperature strength in all cases. In contrast, the high-temperature strength is low in the test pieces for comparison Nos. 1 to 4, 8, 9 and 12. While the test pieces for comparison Nos. 5 to 7, 10 and 11 show satisfactory high-temperature strength, the test pieces for comparison Nos. 7, 10 and 11 are poor in the room-temperature fracture toughness, and the test pieces for comparison Nos. 5 and 6 are poor in the high-temperature oxidation resistance.

According to the present invention, as described above in detail, it is possible to obtain a heat-resistant TiAl alloy excellent in room-temperature fracture toughness, high-temperature oxidation resistance and high-temperature strength, thus providing industrially useful effects.

What is claimed is:

1. A TiAl heat-resistant alloy excellent in a room-temperature fracture toughness, a high-temperature oxidation resistance and a high-temperature strength, consisting essentially of:

| | |
|---|---|
| aluminum | from 29 to 35 wt. %, |
| niobium | from 0.5 to 20 wt. %, |

at least one element selected from the group consisting of:

| | |
|---|---|
| silicon and zirconium | from 0.1 to 1.8 wt. %, from 0.3 to 5.5 wt. %, |

and the balance being titanium and incidental impurities.

2. The TiAl heat-resistant alloy as claimed in claim 1 wherein the respective contents of oxygen, nitrogen and hydrogen as said incidental impurities are limited to:

up to 0.6 wt. % for oxygen, up to 0.1 wt. % for nitrogen, and up to 0.05 wt. % for hydrogen.

3. The TiAl heat-resistant alloy as claimed in claim 1 wherein, said aluminum content is from 30 to 35 wt. %, said silicon content is from 0.1 to about 1.2 wt. % and said zirconium content is from 0.3 to about 5 wt. %.

4. The TiAl heat-resistant alloy as claimed in claim 2 which consists essentially of from 30 to 35 wt. % aluminum, from 0.5 to 20 wt. % niobium, from 0.1 to about 1.3 wt. % silicon and the balance being titanium and incidental impurities.

5. The TiAl heat-resistant alloy as claimed in claim 2 which consists essentially of from 30 to 35 wt. % aluminum, from 0.5 to 20 wt. % niobium, from 0.3 to about 5 wt. % zirconium and the balance being titanium and incidental impurities.

6. The TiAl heat-resistant alloy as claimed in claim 1, which contains 29.26 wt. % aluminum, 4.31 wt. % niobium and 0.92 wt. % silicon.

7. The TiAl heat-resistant alloy as claimed in claim 1, which contains 30.30 wt. % aluminum, 4.12 wt. % niobium and 0.97 wt. % silicon.

8. The TiAl heat-resistant alloy as claimed in claim 1, which contains 31.94 wt. % aluminum, 3.86 wt. % niobium and 1.28 wt. % silicon.

9. The TiAl heat-resistant alloy as claimed in claim 1, which contains 33.45 wt. % aluminum, 4.04 wt. % niobium and 1.03 wt. % silicon.

10. The TiAl heat-resistant alloy as claimed in claim 1, which contains 34.93 wt. % aluminum, 4.08 wt. % niobium and 0.98 wt. % silicon.

11. The TiAl heat-resistant alloy as claimed in claim 1, which contains 32.95 wt. % aluminum, 5.03 wt. % niobium and 0.11 wt. % silicon.

12. The TiAl heat-resistant alloy as claimed in claim 1, which contains 32.47 wt. % aluminum, 4.92 wt. % niobium and 0.52 wt. % silicon.

13. The TiAl heat-resistant alloy as claimed in claim 1, which contains 32.90 wt. % aluminum, 4.84 wt. % niobium and 1.36 wt. % silicon.

14. The TiAl heat-resistant alloy as claimed in claim 1, which contains 33.07 wt. % aluminum, 2.53 wt. % niobium and 0.32 wt. % zirconium.

15. The TiAl heat-resistant alloy as claimed in claim 1, which contains 32.63 wt. % aluminum, 2.77 wt. % niobium and 0.50 wt. % zirconium.

16. The TiAl heat-resistant alloy as claimed in claim 1, which contains 33.47 wt. % aluminum, 2.46 wt. % niobium and 1.43 wt. % zirconium.

17. The TiAl heat-resistant alloy as claimed in claim 1, which contains 31.95 wt. % aluminum, 2.03 wt. % niobium and 3.19 wt. % zirconium.

18. The TiAl heat-resistant alloy as claimed in claim 1, which contains 32.44 wt. % aluminum, 2.38 wt. % niobium and 4.25 wt. % zirconium.

19. The TiAl heat-resistant alloy as claimed in claim 1, which contains 33.08 wt. % aluminum, 2.09 wt. % niobium and 4.95 wt. % zirconium.

20. The TiAl heat-resistant alloy as claimed in claim 1, which contains 32.41 wt. % aluminum, 0.52 wt. % niobium and 1.39 wt. % silicon.

21. The TiAl heat-resistant alloy as claimed in claim 1, which contains 33.06 wt. % aluminum, 5.61 wt. % niobium and 1.04 wt. % silicon.

22. The TiAl heat-resistant alloy as claimed in claim 1, which contains 32.47 wt. % aluminum, 11.08 wt. % niobium and 0.92 wt. % silicon.

23. The TiAl heat-resistant alloy as claimed in claim 1, which contains 32.92 wt. % aluminum, 14.97 wt. % niobium and 1.11 wt. % silicon.

24. The TiAl heat-resistant alloy as claimed in claim 1, which contains 33.09 wt. % aluminum, 19.89 wt. % niobium and 0.97 wt. % silicon.

25. The TiAl heat-resistant alloy as claimed in claim 1, which contains 32.68 wt. % aluminum, 1.86 wt. % niobium, 1.00 wt. % silicon and 3.17 wt. % zirconium.

* * * * *